US010563370B2

(12) United States Patent
Savinkoff et al.

(10) Patent No.: US 10,563,370 B2
(45) Date of Patent: Feb. 18, 2020

(54) BOLTING ADAPTER MECHANISM FOR SONIC PILE DRIVING

(71) Applicant: Terra Sonic International, LLC, Marietta, OH (US)

(72) Inventors: James Savinkoff, Reno, OH (US); Edwin Sprout, Walker, WV (US)

(73) Assignee: Terra Sonic International, LLC, Marietta, OH (US)

( * ) Notice: Subject to any disclaimer, the term of this patent is extended or adjusted under 35 U.S.C. 154(b) by 3 days.

(21) Appl. No.: 15/962,385

(22) Filed: Apr. 25, 2018

(65) Prior Publication Data

US 2018/0313052 A1 Nov. 1, 2018

Related U.S. Application Data

(60) Provisional application No. 62/492,522, filed on May 1, 2017.

(51) Int. Cl.

| | |
|---|---|
| ***E02D 5/22*** | (2006.01) |
| ***E02D 11/00*** | (2006.01) |
| ***E02D 7/18*** | (2006.01) |

(52) U.S. Cl.

CPC ..... *E02D 7/18* (2013.01)

(58) Field of Classification Search

CPC .. E02D 5/22; E02D 7/00; E02D 11/00; E02D 7/18

USPC ..... 405/229–257; 403/292, 293, 294, 296, 403/301, 306; 175/18, 323, 394

See application file for complete search history.

(56) References Cited

U.S. PATENT DOCUMENTS 1,486,414 A * 3/1924 Brier ..... E02D 5/60 405/257
1,844,871 A * 2/1932 Schmedes ..... E02D 5/72 405/246

(Continued)

FOREIGN PATENT DOCUMENTS

CN 105569558 A 5/2016
FR 2656044 A1 6/1991

OTHER PUBLICATIONS

International Searching Authority, Search Report and Written Opinion issued in International Application No. PCT/US18/12523 dated Mar. 9, 2018 (10 pages).

*Primary Examiner* — Benjamin F Fiorello
*Assistant Examiner* — Edwin J Toledo-Duran
(74) *Attorney, Agent, or Firm* — Wood Herron & Evans LLP

(57) ABSTRACT

A sonic pile driving adapter is configured to couple a drill head to a member to be pile driven. The adapter includes an upper attachment portion for selectively attaching to the drill head and a lower mounting portion. The lower mounting portion has first and second side plates configured to be inserted into the member. The first and second side plates include a first plurality of through holes corresponding to a second plurality of through holes provided on the member. The adapter also includes a plurality of brackets with a third plurality of through holes. A plurality of fasteners extends through the first, second and third pluralities of through holes, thereby coupling the sonic pile driving adapter and the drill head to the member. The adapter and method of use allow for efficient transfer of oscillating energy to the member and more effective pile driving.

11 Claims, 7 Drawing Sheets

(56) References Cited

U.S. PATENT DOCUMENTS 2,430,879 A * 11/1947 Kohn ..... E02D 5/48 405/243
2,996,887 A * 8/1961 Rice ..... E02D 7/30 405/245
3,107,497 A * 10/1963 Hoppe ..... E02D 7/30 405/246
3,187,825 A * 6/1965 Bower, Jr. ..... E21B 10/44 175/327
3,272,537 A * 9/1966 Bellatorre ..... F16L 21/08 285/187
3,345,826 A * 10/1967 Hignite ..... E02D 5/385 405/251
3,462,021 A * 8/1969 Hawke ..... A47F 5/14 211/182
3,585,803 A * 6/1971 Bardgette ..... E02D 5/523 405/251
3,796,057 A * 3/1974 Dougherty ..... F16L 21/002 405/251
3,851,485 A * 12/1974 Steding ..... E02D 5/34 405/233
3,986,369 A * 10/1976 Rusche ..... E02D 5/285 405/232
3,986,570 A * 10/1976 Stinson ..... E21B 10/44 175/320
3,995,438 A * 12/1976 Pogonowski ..... B21D 39/20 405/244
4,009,582 A * 3/1977 LeCorgne ..... E02D 5/385 405/240
4,099,585 A * 7/1978 Emmerich ..... E21B 10/38 175/320
4,102,141 A * 7/1978 Ingalls ..... E02D 5/48 405/232
4,102,409 A 7/1978 Lagerstedt
4,214,840 A * 7/1980 Beales ..... E02F 3/3622 172/272
4,621,688 A 11/1986 Bodine
4,662,793 A * 5/1987 Mares ..... E02D 5/72 405/253
4,668,119 A * 5/1987 Galletti ..... E02D 5/285 403/343
4,673,315 A * 6/1987 Shaw ..... E02D 35/00 405/229
4,691,818 A * 9/1987 Weber ..... B65G 33/32 198/666
4,738,568 A * 4/1988 Steding ..... E02D 15/04 405/233
4,763,878 A * 8/1988 Abraham ..... E02D 37/00 254/100
4,903,354 A * 2/1990 Yeh ..... A47C 19/022 403/292
4,949,525 A * 8/1990 Weaver ..... E04H 12/32 116/173
5,013,190 A * 5/1991 Green ..... E02D 35/00 254/29 R
5,039,256 A * 8/1991 Gagliano ..... E02D 5/30 405/229
5,110,237 A * 5/1992 Hesse ..... E02D 13/10 173/128
5,149,149 A * 9/1992 Wu ..... F16B 7/0413 285/396
5,213,448 A * 5/1993 Seider ..... E02D 27/48 405/229
5,465,929 A * 11/1995 Dooley ..... H02G 3/0456 248/68.1
5,484,233 A * 1/1996 Kunito ..... E02D 3/12 405/240
5,575,591 A * 11/1996 Vanderklaauw ..... E01D 2/00 405/230
5,575,593 A * 11/1996 Raaf ..... E02D 5/30 405/232
5,636,944 A * 6/1997 Buttimore ..... E04H 12/2246 248/530
5,683,207 A * 11/1997 Mauer ..... E02D 5/74 405/231
5,733,068 A * 3/1998 Reinert, Sr. ..... E02D 7/26 173/184
5,791,820 A * 8/1998 Rempel ..... E02D 7/20 254/264
5,797,705 A * 8/1998 Kellner ..... E02D 5/385 405/253
5,813,800 A * 9/1998 Doleshal ..... E02D 5/64 405/232
6,030,142 A * 2/2000 Malizia ..... F16M 11/38 403/234
6,050,740 A * 4/2000 Dziedzic ..... E02D 5/74 403/305
6,105,603 A * 8/2000 Alford ..... E03B 9/02 137/291
6,183,167 B1 * 2/2001 Ruiz ..... E02D 5/285 403/379.3
6,318,952 B1 * 11/2001 Waggoner ..... B66C 1/24 294/67.2
6,334,733 B1 * 1/2002 Tyson ..... F16B 7/182 403/306
6,340,790 B1 * 1/2002 Gordin ..... E04H 12/2253 174/45 R
6,539,677 B1 * 4/2003 Lanka ..... E04G 17/002 248/354.3
6,615,554 B2 * 9/2003 Rupiper ..... E02D 5/801 405/252.1
6,814,525 B1 * 11/2004 Whitsett ..... E02D 5/38 405/233
6,942,430 B1 * 9/2005 Suver ..... E02D 5/56 405/232
7,080,958 B1 * 7/2006 Morris ..... E02D 7/18 173/162.1
7,220,081 B1 * 5/2007 Gantt, Jr. ..... E02D 27/12 405/230
7,300,230 B2 * 11/2007 Ong ..... E02D 35/00 405/230
7,651,300 B2 * 1/2010 Carlson ..... E02D 17/00 173/45
7,699,119 B1 * 4/2010 Lunde ..... E21B 17/046 175/18
7,731,454 B1 * 6/2010 Watson, III ..... E02D 5/56 405/231
8,132,649 B2 * 3/2012 Rogers ..... E04G 7/20 182/178.6
8,209,935 B2 * 7/2012 Heady ..... E04G 23/0229 52/745.09
8,235,147 B1 * 8/2012 Seegmiller ..... E21B 10/32 175/272
8,888,413 B2 * 11/2014 Seider ..... E02D 5/523 405/229
9,598,832 B2 * 3/2017 Abrisketa Lozano .. E02D 5/223
10,024,019 B1 * 7/2018 Hunter ..... E02D 5/526
2003/0172487 A1 * 9/2003 Thompson ..... B08B 9/027 15/304
2004/0076479 A1 * 4/2004 Camilleri ..... E02D 5/56 405/252.1
2004/0173383 A1 * 9/2004 Hollingsworth ..... E21B 7/005 175/323
2005/0074298 A1 * 4/2005 Jones ..... E02D 5/523 405/252.1
2005/0074299 A1 * 4/2005 Nolan ..... E02D 5/801 405/259.1
2005/0155758 A1 7/2005 Webb et al.
2005/0238442 A1 * 10/2005 Queen ..... E02D 27/48 405/230
2006/0175837 A1 * 8/2006 Ignaczak ..... F16L 21/065 285/420
2006/0275085 A1 * 12/2006 Ong ..... E02D 35/00 405/230
2008/0159813 A1 * 7/2008 Wissmann ..... E02D 3/08 405/232
2008/0170912 A1 * 7/2008 Kaufman ..... E02D 35/00 405/232

(56) References Cited

U.S. PATENT DOCUMENTS

| | | | | |
|---|---|---|---|---|
| 2009/0269145 | A1* | 10/2009 | Castle | E02D 5/64 405/232 |
| 2010/0178114 | A1* | 7/2010 | Reeves | E02D 13/04 405/232 |
| 2010/0232887 | A1* | 9/2010 | Parsons | E02D 5/385 405/237 |
| 2012/0087741 | A1* | 4/2012 | Desmeules | E02D 5/285 405/251 |
| 2012/0328374 | A1* | 12/2012 | El Naggar | E02D 7/22 405/233 |
| 2013/0184090 | A1* | 7/2013 | Sternberg | E01C 7/142 473/173 |
| 2013/0189040 | A1* | 7/2013 | Atchley | E02D 7/30 405/232 |
| 2014/0030029 | A1* | 1/2014 | Gregory | E02D 5/22 405/232 |
| 2014/0105689 | A1* | 4/2014 | Klekotka | E02D 7/00 405/233 |
| 2014/0132000 | A1* | 5/2014 | Ben-Horin | F16K 27/0218 285/373 |
| 2014/0356076 | A1* | 12/2014 | Hale | E02D 5/223 405/255 |
| 2015/0361634 | A1* | 12/2015 | Abrisketa Lozano | E02D 5/223 405/232 |
| 2016/0010675 | A1* | 1/2016 | Chu | F16B 12/32 403/296 |
| 2016/0010782 | A1* | 1/2016 | Skinner | F16L 55/18 285/15 |
| 2016/0333540 | A1* | 11/2016 | Kaufman | E02D 5/526 |
| 2017/0218590 | A1* | 8/2017 | Raposo | E02D 5/00 |
| 2018/0155893 | A1* | 6/2018 | Fuller | E02D 7/00 |

* cited by examiner

BOLTING ADAPTER MECHANISM FOR SONIC PILE DRIVING

CROSS REFERENCE TO RELATED APPLICATION

This application claims the benefit of U.S. Provisional Patent Application Ser. No. 62/492,522, filed May 1, 2017, the disclosure of which is incorporated by reference herein in its entirety.

TECHNICAL FIELD

This application relates generally to pile driving systems and methods. More specifically, this application describes mechanisms and methods for adapting a sonic drill head to a member that is to be driven in a pile driving application.

BACKGROUND

Pile drivers are mechanical devices used to drive piles, poles, I-beams, or other members into the ground or other surfaces to provide foundation support for buildings or other structures. Although pile drivers are well-established, it is always desirable to improve the speed and reliability of the equipment used. Thus, a recent innovation finding more use in the field is vibration-enhanced pile driving equipment. One particular example is a sonic pile driver.

Vibratory or sonic pile drivers include a sonic drill head which may be lifted and positioned over the member by a drill rig mast, excavator or crane, and then fastened to the member. Such pile drivers may be designed to generate mechanical oscillating forces wherein horizontal vibrations cancel out, while vertical vibrations (e.g., those most effective at improving pile driving speed and reliability) are transmitted into the member. These vibrations may be used to either drive in or extract the member, and the vibration rates may range from about 0 Hz to about 150 Hz (vibration cycles per second). In order to effectively and efficiently transmit the vibrations from the sonic drill head to the member, the coupling between the sonic drill head and member should be tight and secure. However, existing sonic drill heads are not optimally designed to form such a tight and secure coupling. As a result, the fastening of a sonic drill head to a member may result in poor transfer of oscillating force, or even slippage between the sonic drill head and the member.

Thus, it would be desirable to provide systems and methods to provide improved coupling of a sonic drill head to a member in order to transfer oscillating force thereto in a more efficient manner, thereby to improve effectiveness of all sonic pile driving applications.

SUMMARY

In accordance with one embodiment, a sonic pile driving adapter includes an upper attachment portion for selectively attaching the adapter to a drill head and a lower mounting portion. The lower mounting portion has at least first and second side plates configured to be inserted into a member to be pile driven. The first and second side plates include a first plurality of through holes corresponding to a second plurality of through holes provided on the member. The adapter also includes a plurality of brackets with a third plurality of through holes positioned for alignment with the corresponding through holes of the first and second pluralities of through holes. The brackets are positioned on an outside surface of the member to sandwich a portion of the member between at least one of the brackets and at least one of the first and second side plates. A plurality of fasteners extends through the first, second and third pluralities of through holes, thereby coupling the sonic pile driving adapter and the drill head to the member.

In one aspect, the first and second side plates are spaced apart from each other to provide at least one of a clearance fit, a location fit, or a transition fit within the member to be pile driven. The adapter of some embodiments includes a plurality of nuts coupled to interior sides of the first and second side plates at locations corresponding to positions of the first plurality of through holes. The fasteners are threaded bolts screwed into threaded engagement with the nuts, in these embodiments. The nuts may be spot welded to the respective first or second side plate to maintain the nuts in position.

In another aspect, the lower mounting portion includes at least one stop plate for limiting insertion of the first and second side plates into the member to a predetermined position. The stop plate is shaped to complement a portion of the member to be pile driven. A spacer plate is provided to extend between the first and second side plates in a further aspect.

In another embodiment, a method is provided for coupling a drill head to a member having first and second walls. The method includes selectively attaching the drill head to an upper attachment portion of an adapter, with the adapter also including a lower mounting portion having first and second side plates including a first plurality of through holes. The adapter is positioned over the member such that the first and second side plates are received between the first and second walls. The first plurality of through holes is aligned with a second plurality of through holes distributed on the first and second walls. The method also includes bolting a plurality of brackets to the first and second walls via the first and second pluralities of through holes to clamp the first and second walls against the first and second side plates, respectively.

The adapter and associated method of the embodiments of this invention advantageously improve coupling of a sonic drill head to a member in order to transfer oscillating force thereto in a more efficient manner, thereby also improving the speed and effectiveness of the pile driving process for the member.

BRIEF DESCRIPTION OF THE DRAWINGS

Various additional features and advantages of the invention will become more apparent to those of ordinary skill in the art upon review of the following detailed description of one or more illustrative embodiments taken in conjunction with the accompanying drawings. The accompanying drawings, which are incorporated in and constitute a part of this specification, illustrate one or more embodiments of the invention and, together with the general description given above and the detailed description given below, serve to explain the one or more embodiments of the invention.

DETAILED DESCRIPTION

With reference to FIGS. 1-6, a sonic pile driving adapter 10 is shown in accordance with one embodiment. As set forth in further detail below, the adapter 10 may be coupled to a sonic drill head 12 and bolted to a member 14 to form a secure and tight connection between the drill head 12 and the member 14. The sonic drill head 12 may then be activated to generate an oscillating force, which may be effectively and efficiently transferred to the member 14 via the adapter 10 without slippage between the member 14 and the adapter 10 and/or drill head 12 for driving in or extracting the member 14 relative to the ground surface. The features of the adapter 10 are set forth in further detail below to clarify each of these functional advantages and other benefits provided in this disclosure, which are applicable to pile driving and potentially other technical applications of this arrangement.

Figure 1:
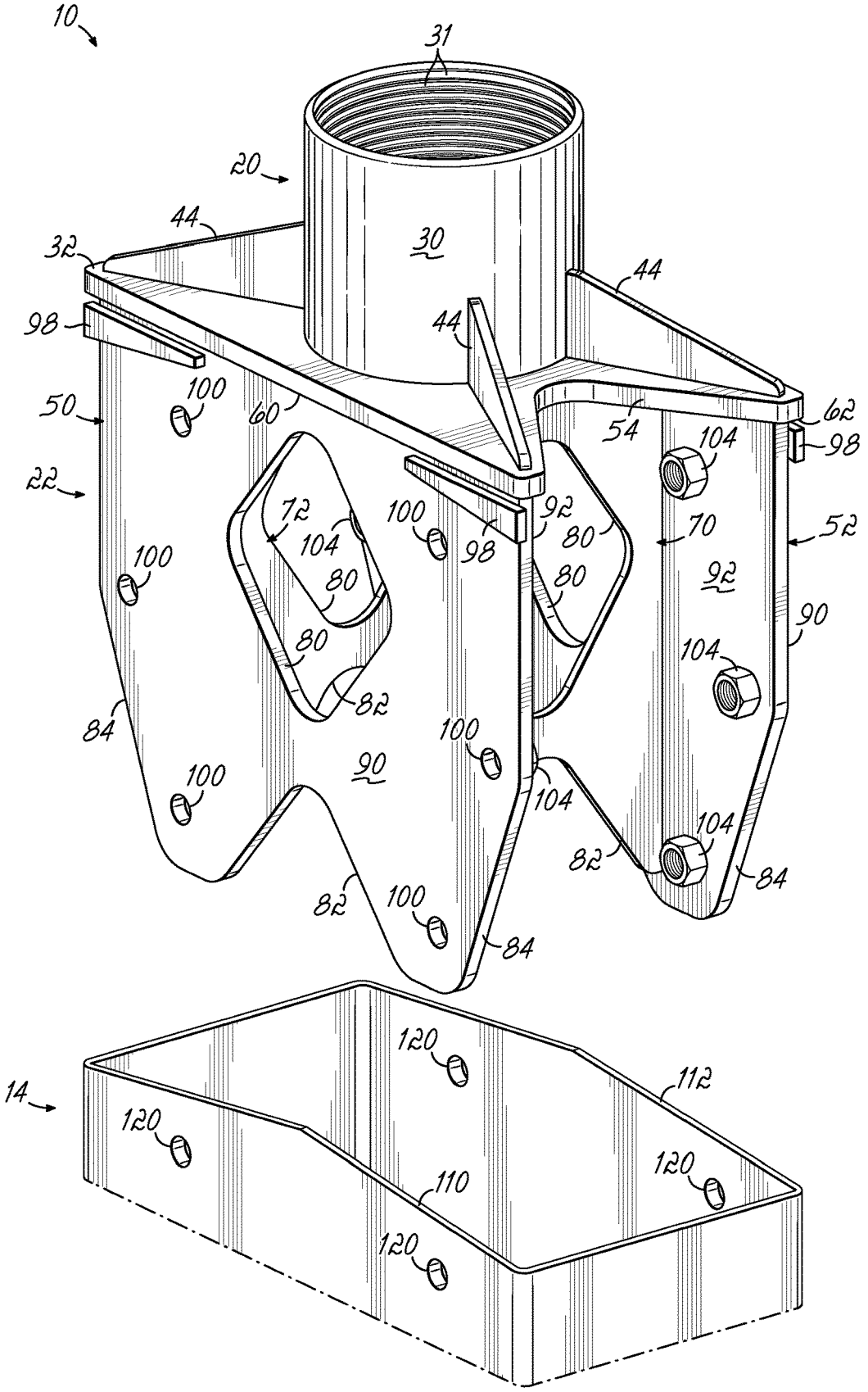
FIG. 1 is a perspective view of an exemplary sonic pile driving adapter in accordance with one embodiment of the invention.
Figure 2:
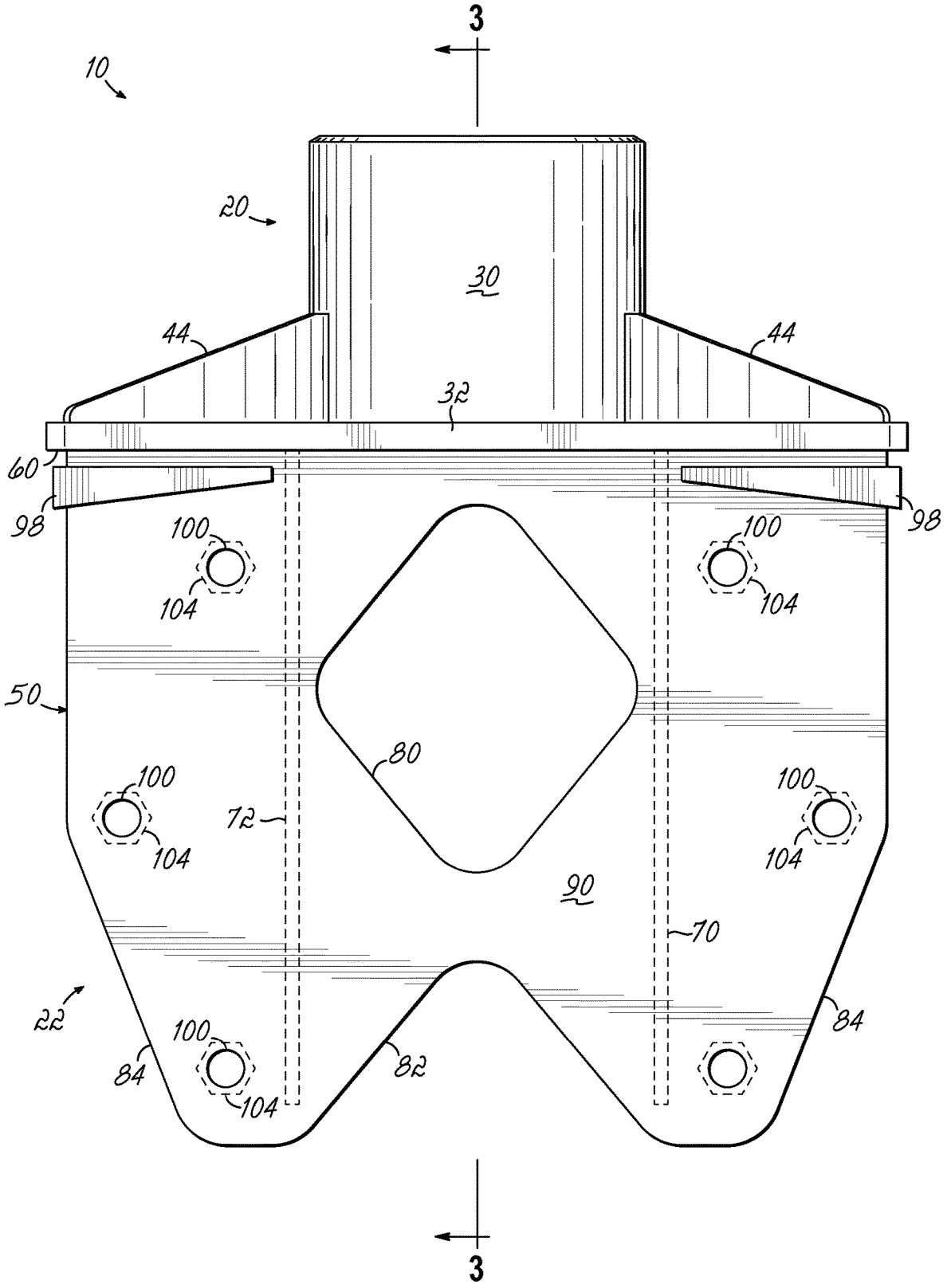
FIG. 2 is a front elevation view of the sonic pile driving adapter of FIG. 1.
Figure 3:
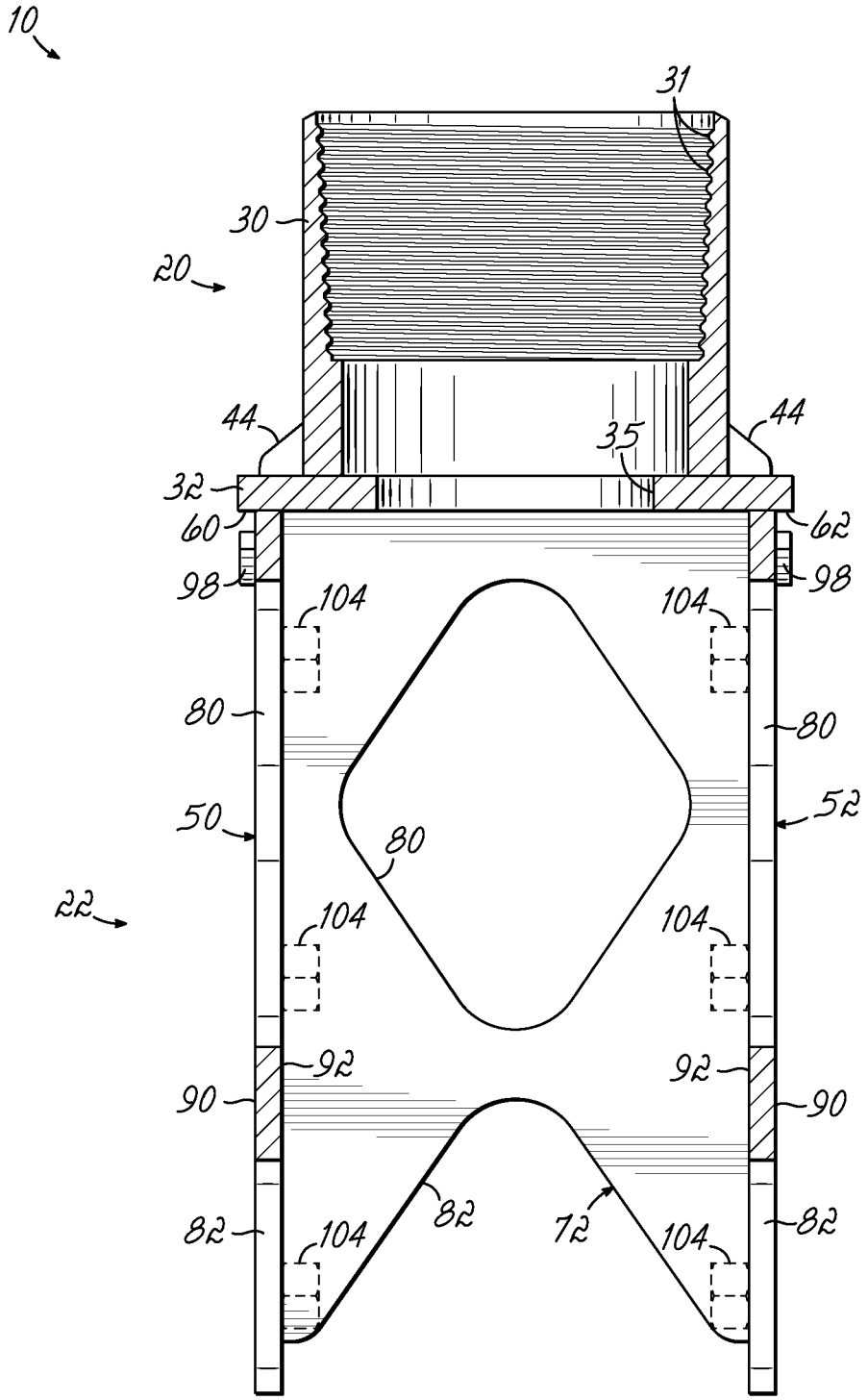
FIG. 3 is a side cross sectional view of the sonic pile driving adapter of FIG. 1, taken along line 3-3 in FIG. 2.
Figure 5:
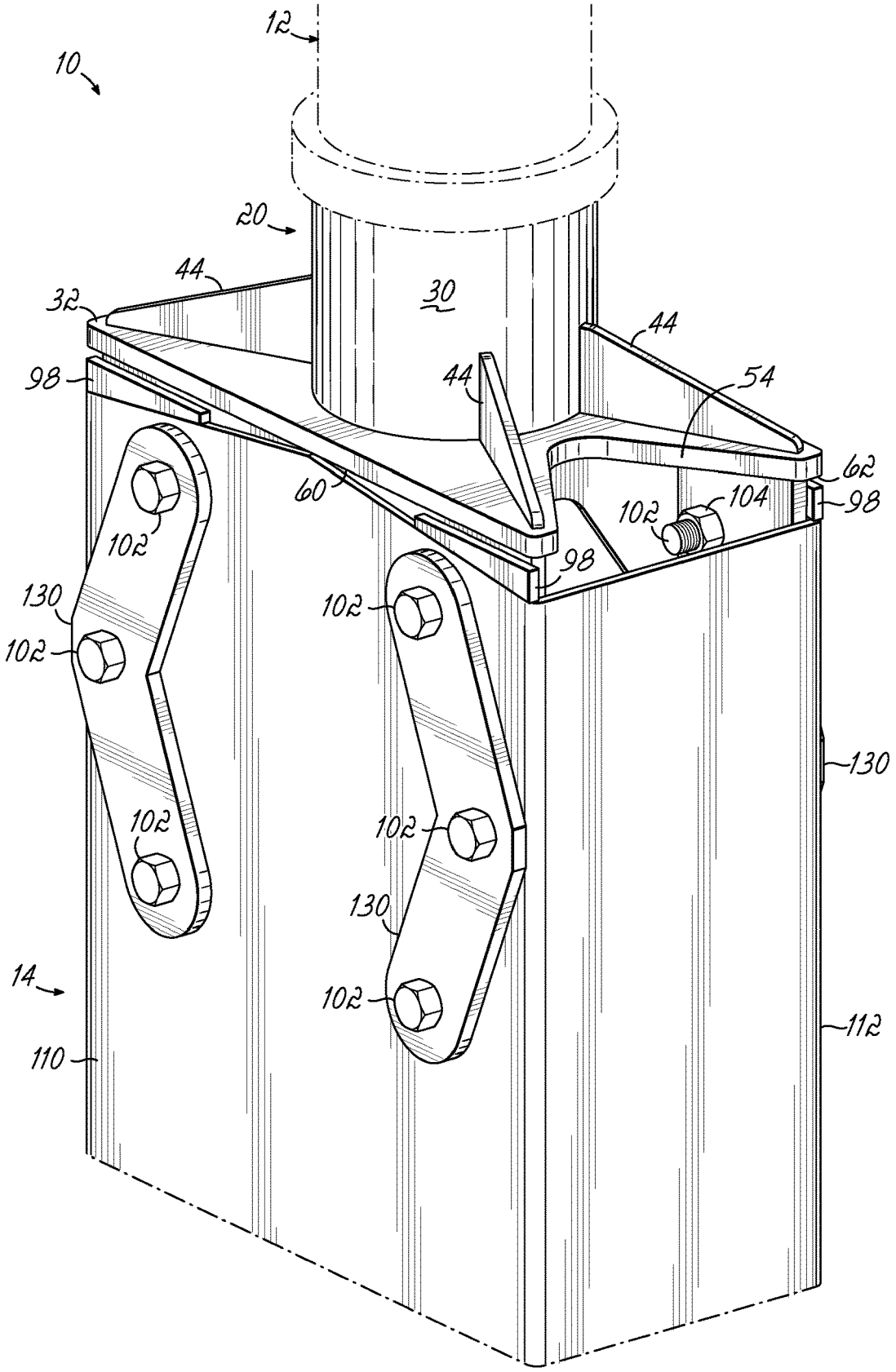
FIG. 5 is a perspective view similar to FIG. 4, showing the sonic pile driving adapter coupled to a sonic drill head (shown in phantom) and bolted to the member to be pile driven.

As shown in FIG. 1, the adapter 10 includes an upper attachment portion 20 and a lower mounting portion 22. The attachment portion 20 is configured for selectively attaching the adapter 10 to a sonic drill head 12 (FIG. 5). The attachment portion 20 includes a cylindrical wall 30 rigidly coupled to a top plate 32 of the mounting portion 22 and also includes a plurality of threads 31 on an internal surface thereof. The cylindrical wall 30 and/or threads 31 are configured to mate with a corresponding threaded spindle 33 (FIG. 6) of the sonic drill head 12 to rigidly couple the adapter 10 to the sonic drill head 12. As shown, the top plate 32 includes an aperture 35 (FIG. 3) for receiving a lowermost portion of the sonic drill head 12 for improved stability between the sonic drill head 12 and the adapter 10. A plurality of gussets or reinforcing members 44 is provided between the cylindrical wall 30 and the top plate 32 in order to provide increased rigidity to the adapter 10. It will be appreciated that the threaded spindle 33 of the sonic drill head 12 may be automatically screwed into the cylindrical wall 30 of the attachment portion 20 via one or more actuators and/or control systems, as is known. As described in further detail below, this configuration of the attachment portion 20 is simply one option for coupling to the drill head 12, and other arrangements are possible within the scope of the invention.

The mounting portion 22 is made to fit the dimensions of the member 14 to be pile driven whether said member is a pile, poles, I-beam, column or other member. Therefore, in the illustrated embodiment, the mounting portion 22 includes first and second side plates 50, 52 extending downwardly from opposing sides of the top plate 32, to match the generally rectangular shape of the sample member 14 to be driven shown in FIG. 1. Recessed portions 54 are provided in the top plate 32 at sides of the top plate 32 adjacent to the sides from which the first and second side plates 50, 52 extend, and are sized and shaped to reduce the amount of material required while ensuring that the top plate 32 is sufficiently rigid for sonic drilling applications, for example. In this regard, the reinforcing members 44 extend in regions of the top plate 32 separated from each other by one or more recesses 54. The recesses 54 may be resized or repositioned in other embodiments without departing from the scope of this invention. As shown, the first and second side plates 50, 52 are spaced slightly inwardly from the periphery of the top plate 32 to provide first and second shoulders 60, 62, respectively.

First and second spacer plates 70, 72 extending between the first and second side plates 50, 52 and generally perpendicular to the first and second side plates 50, 52 provide increased rigidity to the side plates 50, 52 and/or assist in maintaining the shape of the mounting portion 22. The spacer plates 70, 72 may also provide a desired spacing of the first side plate 50 from the second side plate 52 such as during manufacture of the adapter 10. Apertures 80, recessed portions 82, and/or beveled portions 84 are provided in the side plates 50, 52 and/or spacer plates 70, 72 and are sized and shaped to reduce the amount of material required while ensuring that the respective plates are sufficiently rigid for sonic drilling applications, for example. In certain applications, the apertures 80 and/or recessed portions 82 may help provide access to interior spaces of the mounting portion 22, such as during installation. It will be understood that the spacer plates 70, 72 may be modified or omitted in other embodiments.

The first and second side plates 50, 52 are spaced apart from each other to be received within and closely engage an upper portion of the member 14 positioned therearound. In particular, each side plate 50, 52 includes an abutment side 90 opposite an interior or interior-facing side 92, and the plates 50, 52 are spaced apart such that the abutment sides 90 may be in contact with or in close proximity with the member 14. In other words, the side plates 50, 52 are spaced apart to provide a close fit between the abutment sides 90 and the member 14. The close fit may be a clearance fit, a location fit, and/or a transition fit. Various stop plates, such as corner stop plates 98, are attached to the first and second side plates 50, 52 and/or the top plate 32 to limit the insertion of the side plates 50, 52 to a predetermined/desired position within the member 14. The stop plates 98 are shaped to complement a profile of the upper portion of the member 14. For example, the stop plates 98 are each angled to complement an upper portion of a member 14 having an angled profile such as a triangular profile. Likewise, it will be understood that a different shape and/or number of side plates on a mounting portion 22 can be used in other embodiments to work with different shapes and sizes of members than the example shown in the drawings. The top plate 32, side plates 50, 52, spacer plates 70, 72, and stop plates 98 are rigidly coupled together such as by, for example, welding, or by integrally forming some or all of the plates together as a unitary piece(s).

A plurality of through holes 100 are provided in each of the first and second side plates 50, 52 for receiving fasteners, shown in this embodiment to be threaded bolts 102 (FIG. 4) for rigidly coupling the adapter 10 to the member 14, as discussed in greater detail below. For example, in the embodiment shown, six through holes 100 are provided in each of the side plates 50, 52. More particularly, the through holes 100 are spaced apart and distributed in two sets of three on each side plate 50, 52. As shown, each set of through holes 100 is arranged in a generally V-shaped or generally triangular pattern. However, any number of through holes 100 in any arrangement may be provided depending on the particular application. A corresponding number of nuts 104 are rigidly attached to the interior sides 92 of each of the side plates 50, 52 at locations corresponding to the positions of the through holes 100. In this manner, a bolt 102 may be inserted into a through hole 100 and screwed into the corresponding nut 104 to secure the bolt 102 to the adapter 10 without requiring personnel to manually hold an individual nut in place, which may be difficult or impossible when the side plates 50, 52 are received within the member 14, depending on the configuration of the member 14 and/or the particular configuration of the adapter 10. The nuts 104 may each be rigidly attached to the respective side plate 50, 52 such as by, for example, spot welding, or by integrally forming each nut 104 together with the respective side plate 50, 52 as a unitary piece.

Figure 4:
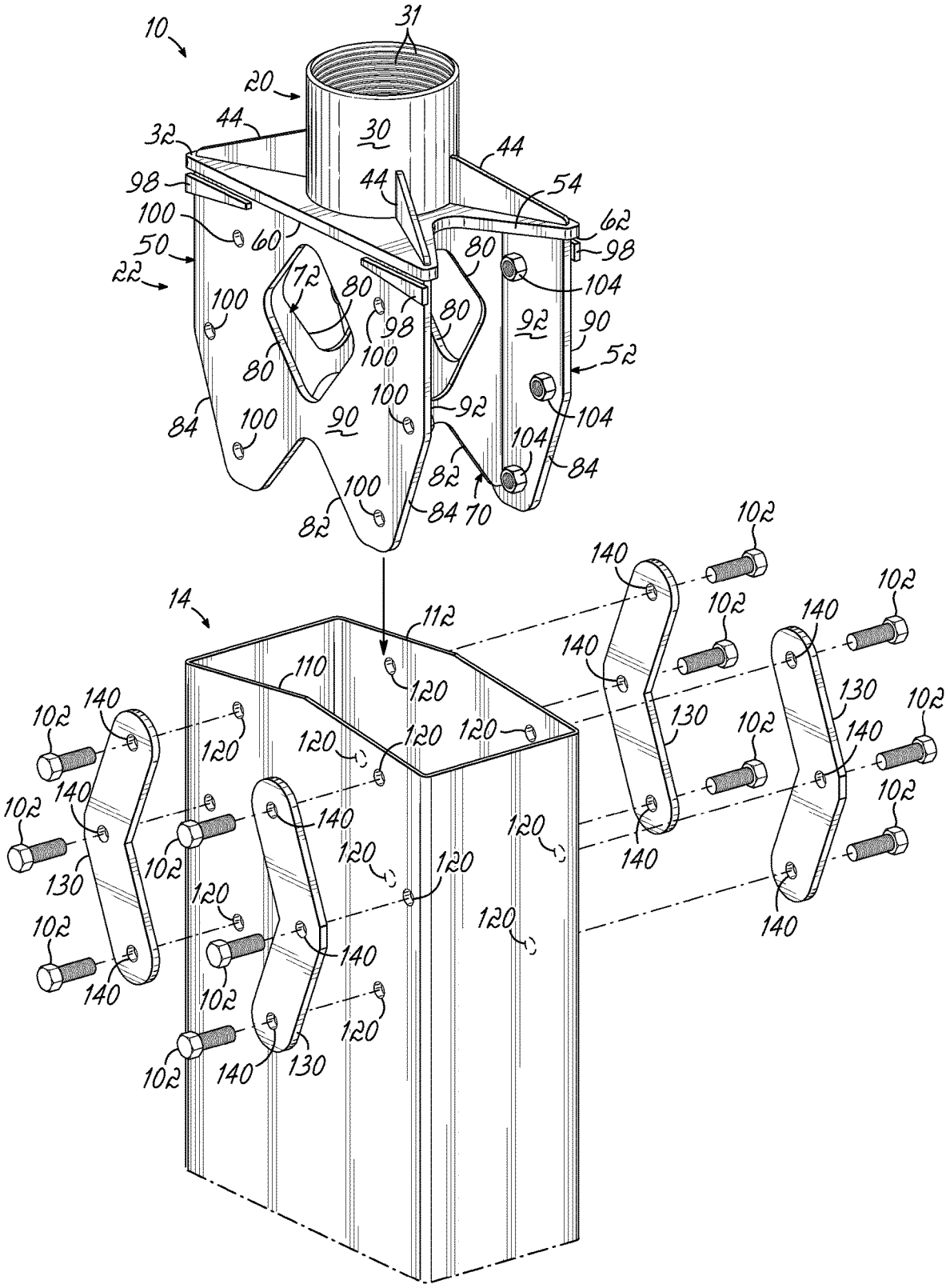
FIG. 4 is a perspective view similar to FIG. 1, showing an exploded view of the sonic pile driving adapter being positioned onto a member to be pile driven.
Figure 6:
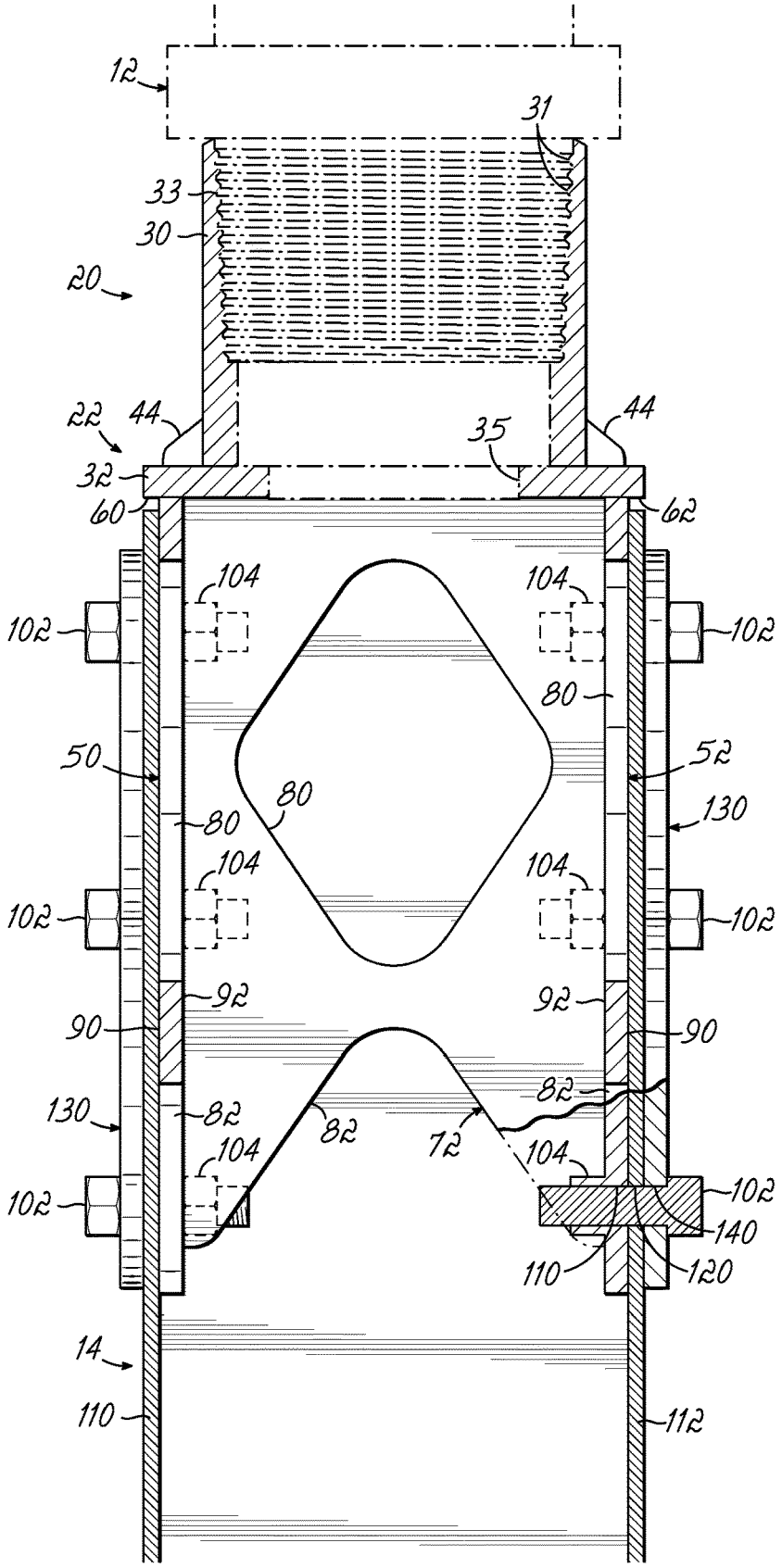
FIG. 6 is a side cross sectional view similar to FIG. 3, showing the sonic pile driving adapter bolted to the member to be pile driven.

With specific reference now to FIGS. 4-6, the sonic pile driving adapter 10 is positioned over a member 14 having at least first and second walls 110, 112. As shown, a plurality of through holes 120 are provided in the first and second walls 110, 112 and correspond to the through holes 100 of the mounting portion 22. In this regard, six through holes 120 are provided in each of the first and second walls 110, 112 in sets of three through holes spaced apart and distributed in a manner similar to the through holes 100 of the mounting portion 22 for alignment therewith. More particularly, each set of through holes 120 is arranged in a generally V-shaped or generally triangular pattern, and is adequately spaced from the upper portion of the member 14 such that when the first and second side plates 50, 52 are inserted into the member 14 between the first and second walls 110, 112 until the walls 110, 112 contact the corresponding stop plates 98 in abutting relation, at which point the through holes 120 of the member 14 are aligned with the corresponding through holes 100 of the mounting portion 22. In this manner, contact between the stop plates 98 and the top of the respective walls 110, 112 indicate that the mounting portion 22 is fully inserted and is properly aligned for bolting securement. In an alternative embodiment, such as when the upper portion of a member 14 is flat, the stop plates 98 may be eliminated and the through holes 120 may be distributed such that contact between the shoulders 60, 62 and the respective walls 110, 112 provide the desired alignment.

With the through holes 100, 120 of the mounting portion 22 and member 14 aligned, a plurality of brackets 130 are positioned against outside surfaces of the first and second walls 110, 112 of the member 14 and secured thereto by the bolts 102, as shown in FIG. 5. To that end, each bracket 130 includes through holes 140 (FIG. 4) spaced apart and distributed in a manner similar to the through holes 100, 120 of the mounting portion 22 and member 14. As shown, an individual bracket 130 is provided for each set of three through holes 100, 120 on the mounting portion 22 and member 14, and each bracket 130 is generally V-shaped to accommodate the arrangement of the through holes 140 while minimizing the amount of material required. However, the brackets 130 may sized and shaped in any other suitable manner depending on the particular application. For example, the brackets may be generally rectangular. In addition or alternatively, a single bracket may be provided for each wall 110, 112 of the member 14 and may have a surface area adequately large to encompass both sets of through holes 120 on the respective wall 110, 112. Thus, the brackets 130 and the side plates 50, 52 sandwich the first and second walls 110, 112 of the member 14.

As the bolts 102 are screwed into the nuts 104, the respective wall 110, 112 becomes sandwiched or clamped between the corresponding side plate 50, 52 and bracket 130 until the bolt 102 is tightly secured, as best shown in FIG. 6. In this manner, the first and second walls 110, 112 are clamped by the side plates 50, 52 and brackets 130 to thereby reliably couple the sonic drill head 12 and the member 14 with the adapter 10. To that end, the sonic drill head 12 is coupled to the attachment portion 20 as previously discussed. It will be appreciated that the sonic drill head 12 may be coupled to the adapter 10 before, during, or after coupling the adapter 10 to the member 14. The bolts 102 directly engage with the brackets 130 and nuts 104 and thereby do not damage the free end of the member 14 during installation or pile driving with the sonic drill head 12.

As shown in FIG. 6, the bolting of the member 14 to the adapter 10 is tight and secure. In particular, the side plates 50, 52 and respective brackets 130, in conjunction with the corresponding bolts 102, may each exert a consistent pressure evenly distributed over a substantial surface area of the respective wall 110, 112 of the member 14. In this regard, the close fit between the walls 110, 112 of the member 14 and the side plates 50, 52 of the mounting portion 22 may allow the side plates 50, 52 and/or brackets 130 to sandwich the walls 110, 112 of the member 14 without substantially bending the walls 110, 112 or side plates 50, 52 or without creating uneven pressure or stress points in the walls 110, 112 or side plates 50, 52. The abutment of the walls 110, 112 of the member 14 against corresponding stop plates 98 (or alternatively, shoulders 60, 62) may contribute to the tight and secure clamping by preventing the uppermost portions of the member 14 from moving freely during operation of the sonic drill head 12.

By providing a tight and secure clamping of the member 14 by the adapter 10, the connection between the sonic drill head 12 and the member 14 via the adapter 10 is substantially rigid. This may prevent slippage of the member 14 relative to the adapter 10 and/or sonic drill head 12 during operation of the sonic drill head 12, and provide an effective and efficient transfer of oscillating forces-from the drill head 12 to the member 14. In one embodiment, various components of the adapter 10 such as, for example, the attachment portion 20, top plate 32, first and second side plates 50, 52, and spacer plates 70, 72, are constructed of a material having a strength and/or durability capable of transferring oscillating forces typical in sonic drilling applications from the drill head 12 to the member 14. For example, various components of the adapter 10 may be constructed of steel.

In order to remove the adapter 10 from the member 14, such as after operation of the sonic drill head 12 to drive in or extract the member 14, the bolts 102 may be loosened and removed from the nuts 104 and through holes 100, 120, 140 to thereby allow the brackets 130 to be removed from the respective walls 190, 192 and unclamp the member 14. The adapter 10 may then be lifted away from the member 14, such as via the sonic drill head 12, and stored or mounted to another member for continued operation, for example.

Various sonic pile driving adapters 10 may be configured to accommodate members 14 of different sizes and shapes, such that a single sonic drill head 12 may be coupled to a variety of members 14 to effectively and efficiently transfer oscillating forces thereto. Thus, it will be appreciated that various features of the illustrated adapter 10 may be modified to accommodate a particular member 14. In particular, the spacing of the first side plate 50 relative to the second side plate 52 may be increased or decreased depending on the spacing of the first and second walls 110, 112 of a member. This may include modifying the sizes of the spacer plates 70, 72. Likewise, the shapes and configurations of the stop plates 98 may be modified depending on the particular features of a member 14, such as a profile of the upper portion of the member 14.

Figure 7:
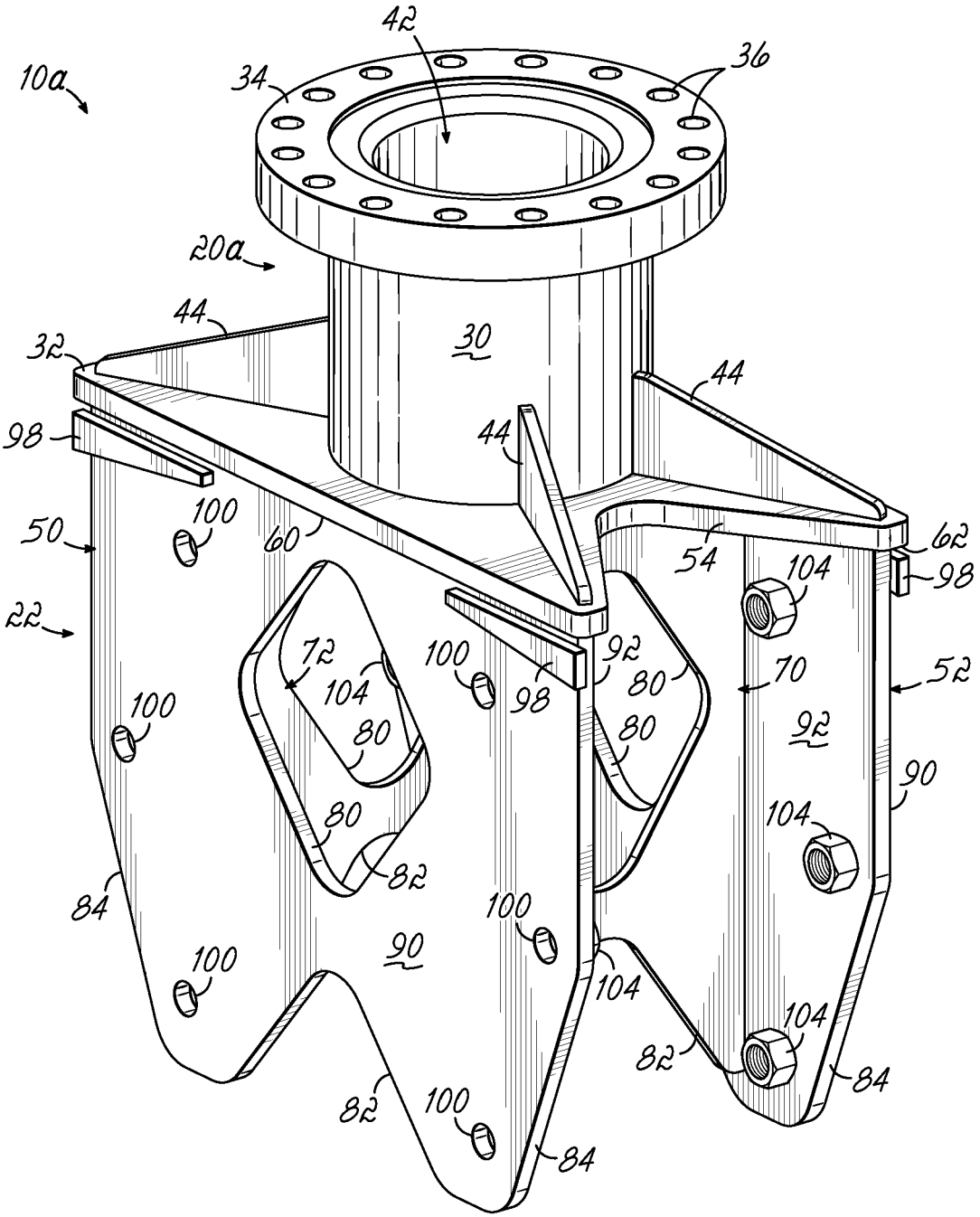
FIG. 7 is a perspective view of an exemplary sonic pile driving adapter in accordance with another embodiment.

With reference now to FIG. 7, wherein like numerals represent like features, in an alternative embodiment, a sonic pile driving adapter 10*a* includes an alternative attachment portion 20*a* mounted to a mounting portion 22 as previously described. The attachment portion 20*a* is configured for selectively attaching the adapter 10*a* to a sonic drill head (not shown). In this embodiment, the attachment portion 20 includes a cylindrical wall 30 rigidly coupled to a top plate 32 of the mounting portion 22 and terminating at a circular flange 34. A plurality of through holes 36 are provided in the circular flange 34 for receiving bolts (not shown) in order to rigidly couple the circular flange 34 to a corresponding flange (not shown) of the sonic drill head. The cylindrical wall 30 defines a passageway 42 which may receive a corresponding shaft of the sonic drill head to provide improved stability between the sonic drill head and the adapter 10*a*. A plurality of reinforcing members 44 is provided between the cylindrical wall 30 and the top plate 32 in order to provide increased rigidity to the adapter 10*a*. The details of the mounting portion 22 and its components are substantially the same as those previously described and are not repeated for the sake of brevity. Thus, the adapter 10*a* of this embodiment continues to provide the advantageous functionality in the pile driving context as set forth above.

While the present invention has been illustrated by the description of various embodiments thereof, and while the embodiments have been described in considerable detail, it is not intended to restrict or in any way limit the scope of the appended claims to such detail. Thus, the various features discussed herein may be used alone or in any combination. Additional advantages and modifications will readily appear to those skilled in the art. The invention in its broader aspects is therefore not limited to the specific details and illustrative examples shown and described. Accordingly, departures may be made from such details without departing from the scope of the general inventive concept.

What is claimed is:

1. A sonic pile driving adapter, comprising:

an upper attachment portion for selectively attaching the adapter to a drill head;

a lower mounting portion including at least first and second side plates configured to be inserted into a member to be sonically pile driven, wherein the first and second side plates include a first plurality of through holes corresponding to a second plurality of through holes provided on the member;

a plurality of brackets including a third plurality of through holes positioned for alignment with corresponding through holes of the first and second pluralities of through holes, the brackets configured to be positioned on an outside surface of the member to sandwich a portion of the member between at least one of the brackets and at least one of the first and second side plates; and a plurality of fasteners that extend through the first, second, and third pluralities of through holes for coupling the sonic pile driving adapter to the member.

2. The sonic pile driving adapter of claim 1, wherein the first and second side plates are spaced apart from each other to provide at least one of a clearance fit, a location fit, or a transition fit within the member to be sonically pile driven.

3. The sonic pile driving adapter of claim 1, further comprising a plurality of nuts coupled to interior sides of the first and second side plates at locations corresponding to positions of the first plurality of through holes, and wherein the fasteners are threaded bolts screwed into the nuts.

4. The sonic pile driving adapter of claim 3, wherein the nuts are spot welded to the respective first or second side plate.

5. The sonic pile driving adapter of claim 1, wherein the lower mounting portion includes at least one stop plate for limiting insertion of the first and second side plates into the member to a predetermined position.

6. The sonic pile driving adapter of claim 5, wherein the at least one stop plate is shaped to complement a portion of the member to be sonically pile driven.

7. The sonic pile driving adapter of claim 1, further comprising:

at least one spacer plate extending between the first and second side plates.

8. A method of coupling a drill head to a member and pile driving the member, the member including first and second walls, comprising:

selectively attaching the drill head to an upper attachment portion of an adapter, the adapter including a lower mounting portion having first and second side plates including a first plurality of through holes;

positioning the adapter over the member such that the first and second side plates are received between the first and second walls and the first plurality of through holes are aligned with a second plurality of through holes distributed on the first and second walls;

bolting a plurality of brackets to the first and second walls via the first and second pluralities of through holes to clamp the first and second walls against the first and second side plates, respectively, and operating the drill head to provide oscillating energy to sonically pile drive the member into a ground surface.

9. The method of claim 8, wherein the adapter includes a plurality of nuts coupled to interior sides of the first and second side plates, and the step of bolting the plurality of brackets to the first and second side walls further comprises:

threadably engaging threaded bolts with the plurality of nuts to cause clamping of the first and second walls against the first and second side plates, respectively.

10. The method of claim 9, wherein the step of positioning the adapter over the member further comprises:

engaging the first and second side plates in at least one of a clearance fit, a location fit, or a transition fit within the member.

11. The method of claim 10, wherein the lower mounting portion includes a stop plate, and the step of positioning the adapter over the member further comprises:

abutting the stop plate against a portion of the member to properly align the first and second pluralities of through holes.

* * * * *